United States Patent [19]

Mochida

[11] Patent Number: 4,536,021

[45] Date of Patent: Aug. 20, 1985

[54] EMERGENCY UNLOCKING MECHANISM FOR DOOR OF AUTOMOBILE

[75] Inventor: Haruo Mochida, Yokohama, Japan

[73] Assignee: Nissan Motor Co., Ltd., Yokohama, Japan

[21] Appl. No.: 393,327

[22] Filed: Jun. 29, 1982

[30] Foreign Application Priority Data

Jul. 8, 1981 [JP] Japan ..... 56-107434

[51] Int. Cl.[3] ..... E05C 3/26

[52] U.S. Cl. ..... 292/201; 292/DIG. 22; 297/379

[58] Field of Search ..... 292/201, 336.3, DIG. 22, 292/DIG. 65; 180/282; 280/806; 297/379

[56] References Cited

U.S. PATENT DOCUMENTS

| | | | |
|---|---|---|---|
| 3,583,741 | 6/1971 | Breitschwerdt et al. | 292/216 |
| 3,719,248 | 3/1973 | Breitschwerdt et al. | 292/DIG. 22 X |
| 3,727,976 | 4/1973 | Lystad | 297/379 X |
| 3,799,596 | 3/1974 | Nozumu et al. | 292/DIG. 22 X |
| 3,990,531 | 11/1976 | Register | 292/DIG. 22 X |
| 4,223,915 | 9/1980 | Tanaka et al. | 280/806 X |
| 4,290,634 | 9/1981 | Gelhard | 292/DIG. 22 X |
| 4,451,062 | 5/1984 | Ziv | 280/806 |

FOREIGN PATENT DOCUMENTS

| | | | |
|---|---|---|---|
| 1816942 | 7/1970 | Fed. Rep. of Germany . | |
| 2708461 | 8/1978 | Fed. Rep. of Germany | 297/379 |
| 2946095 | 5/1981 | Fed. Rep. of Germany | 292/DIG. 22 |
| 2001109 | 9/1969 | France | 292/336.3 |
| 2228384 | 11/1974 | France | 292/DIG. 22 |

*Primary Examiner*—Gary L. Smith
*Assistant Examiner*—Russell W. Illich
*Attorney, Agent, or Firm*—Lane, Aitken & Kananen

[57] ABSTRACT

A locking system for a door of an automobile is provided with an emergency unlocking means which detects critical deceleration or acceleration of the automobile by the aid of inertia and transmits inertial movement to the locking system to cause it to move from its locking position to its unlocking position. Preferably, the emergency unlocking means comprises an inertia lever having a weight pendulum capable of swinging and thereby pushing a member of the locking system, and holding means for normally holding the inertia lever in its normal position.

5 Claims, 12 Drawing Figures

11
12
13
14
15
17
18
19
20
23
30
31
32
33
34
35

EMERGENCY UNLOCKING MECHANISM FOR DOOR OF AUTOMOBILE

BACKGROUND OF THE INVENTION

The present invention relates to a locking system for a door of an automobile, and more specifically to a locking system having an emergency unlocking mechanism.

Doors of an automobile are locked and unlocked by manipulating a door lock cylinder from the outside or a door lock knob from the inside. If an automobile comes into collision with its doors locked and the driver and passengers become unable to move within the automobile, the rescue of them is delayed because the doors can not be easily opened from the outside.

Accordingly, an automatic door locking system having a so-called G sensor for detecting acceleration of a vehicle has been proposed. However, this system is arranged to automatically unlock the door in response to the output signal of the G sensor by using an electromechanical system, and therefore, requires many costly electrical devices. Besides, the reliability of such a system is not sufficient because it is subject to electric contact failure.

SUMMARY OF THE INVENTION

It is an object of the present invention to provide a locking system of an automobile door which is capable of automatically and reliably unlocking the door with a simple mechanism in emergency.

According to the present invention, a locking system comprises a lock unit for locking and unlocking the door, linkage means connected with the lock unit for transmitting movement caused by manipulation to the lock unit, and inertia actuating means which can move by reason of its inertia when a deceleration of a rate higher than a predetermined level takes place, and causes the linkage means to move in such a direction as to move the lock unit into its unlocking position. To be accurate, the lock unit has a locking position in which the door is locked and an unlocking position in which the door is not locked, and the linkage means has a lock directing position in which the linkage means puts the lock unit in its locking position and an unlock directing position in which the linkage means puts the lock unit in its unlocking position. The inertia actuating means is normally held in a normal position but is movable to a first actuating position. When a deceleration of a rate higher than the predetermined level takes place, the inertia actuating means moves from its normal position to its first actuating position by reason of its inertia. By this movement, the inertia actuating means causes the linkage means to move from its lock directing position to its unlock directing position thereby to cause the lock unit to move from its locking position to its unlocking position.

Preferably, the inertia actuating means comprises an inertia lever which has a weight pendulum and can swing in a vertical plane on a fulcrum from its normal position to its first actuating position, and holding means for normally holding the inertia lever in its normal position and allowing the inertia lever to swing to its first actuating position when a deceleration of a rate higher than the predetermined level takes place.

DETAILED DESCRIPTION OF THE INVENTION

Figure 1:
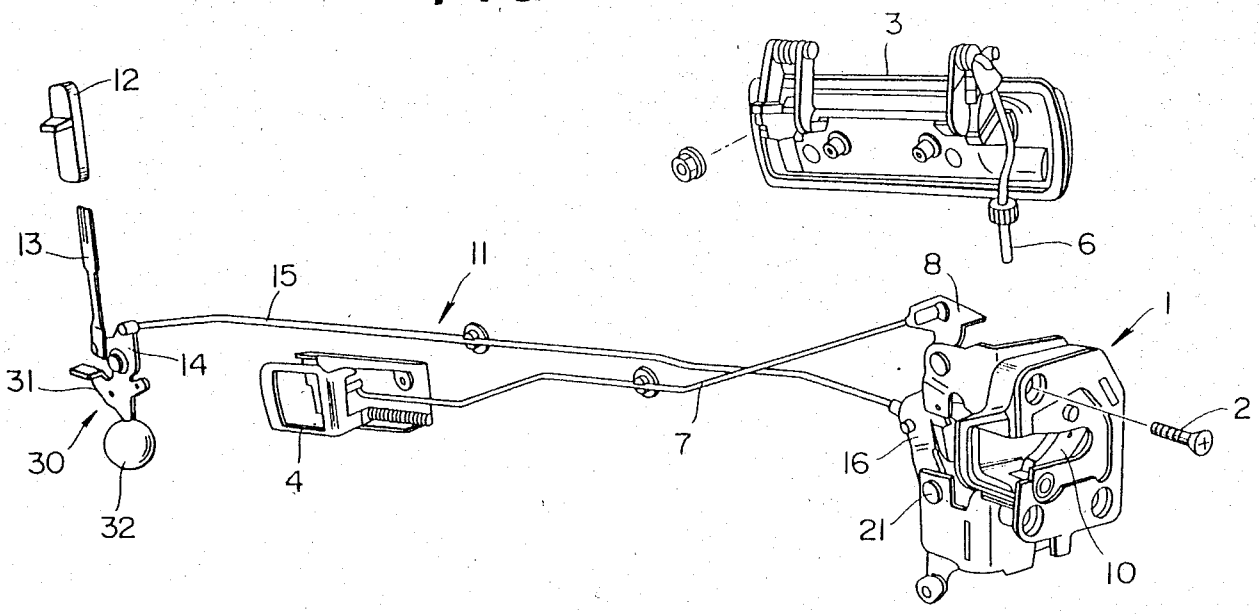
FIG. 1 is a perspective view of an automobile door locking system according to the present invention.

In FIGS. 1 and 2, a door lock unit 1 is fastened to the rear end of a door (not shown), and an outside handle 3 and an inside handle 4 are fixed, respectively, to an outer panel and an inner panel of the door. The outside handle 3 and the inside handle 4 are connected with a release lever 8 of the door lock unit 1 by rods 6 and 7, respectively. When either one of the inside handle and the outside handle is manipulated, the release lever 8 actuates a locking plate (not shown) to release a latch 10 from the engagement with a door striker (not shown) fixed to a vehicle body.

There is further provided a lock linkage 11, which comprises, in this embodiment, a door lock knob rod 13 connected to a door lock knob 12, a bell crank 14, an intermediate rod 15, and a lock lever 16.

The lower end of the door lock knob rod 13 is connected with a first arm of the bell crank 14 by a joint pin 17 forming a pin joint. The bell crank 14 is pivotally mounted, with the interposition of a base plate or directly, on the inner panel 18 of the door by a fulcrum pin 19. A second arm of the bell crank 14 is connected with one end of the intermediate rod 15 by a joint pin 20 forming a pin joint. The lock lever 16 is pivotally mounted on the door lock unit 1 by a pin 21 and connected with the intermediate rod 15.

When the door lock knob rod 13 is pushed down by manipulation of the lock knob 12, the lock linkage 11 transmits this motion through the bell crank 14, and the intermediate rod 15, to the lock lever 16 and, brings the lock lever 16 to its locking position. When the locking lever 16 is in its locking position, the release lever 8 is made unable to perform its function, and therefore, the door can not be opened by the outside handle 3 and the inside handle 4. The lock lever 16 can be also actuated by a lock cylinder fixed to the outer panel of the door. The lock lever 16 can be returned to its unlocking position by pulling the lock knob 12. When the lock lever 16 is in its unlocking position, the door can be opened freely by the outside handle 3 or the inside handle 4.

According to the present invention, there is further provided, in the lock linkage 11, an inertia actuator 30 which detects a predetermined deceleration with the aid of inertia and forces the lock linkage 11 to move toward the unlocking direction. In this embodiment, the inertia actuator 30 is mounted in relation with the bell crank 14.

The inertia actuator 30 mainly comprises an inertia lever 31 having, in its lower end, a weight portion 32, and holding means such as a setting spring 33 for normally holding the weight portion 32 in its inoperative state. The inertia lever 31 is pivotally supported on the fulcrum pin 19 on which the bell crank 14 is also pivoted in common. The inertia lever 31 has, in one side, an actuating portion 34 which is in contact with or close to the underside of the knob rod side first arm of the bell crank 14 when the bell crank 14 is in its locking position with the knob rod being pushed down. The inertia lever has, in the other side, a stop portion 35 which is loosely received in a slide slit 23 formed in the base plate (not shown) or the inner panel 18 of the door. The spring 33 is mounted on the fulcrum pin 19. One end of the spring 33 is fixed to the base plate or the inner panel 18 of the door, and the other end thereof is fixed to the inertia lever 31. Thus, the spring 33 holds the inertia lever 31 in the position in which the stop portion 35 of the inertia lever 31 abuts against the right end, in FIG. 2A, of the slide slit 23. The holding means of the spring 33 restricts the inertial movement of the inertia lever 31. That is, the spring 33 holds the inertia lever 33 stationary irrespective of deceleration during abrupt braking or while the vehicle is bouncing along a rugged road. The spring 33 allows the inertia lever 31 to move under the influence of inertia only when the inertia lever undergoes more steep deceleration or acceleration as in the case of collision causing heavy damage to the vehicle. For this end, the spring constant of the spring 33 is appropriately adjusted.

Figures 2A, 2B, 2C:
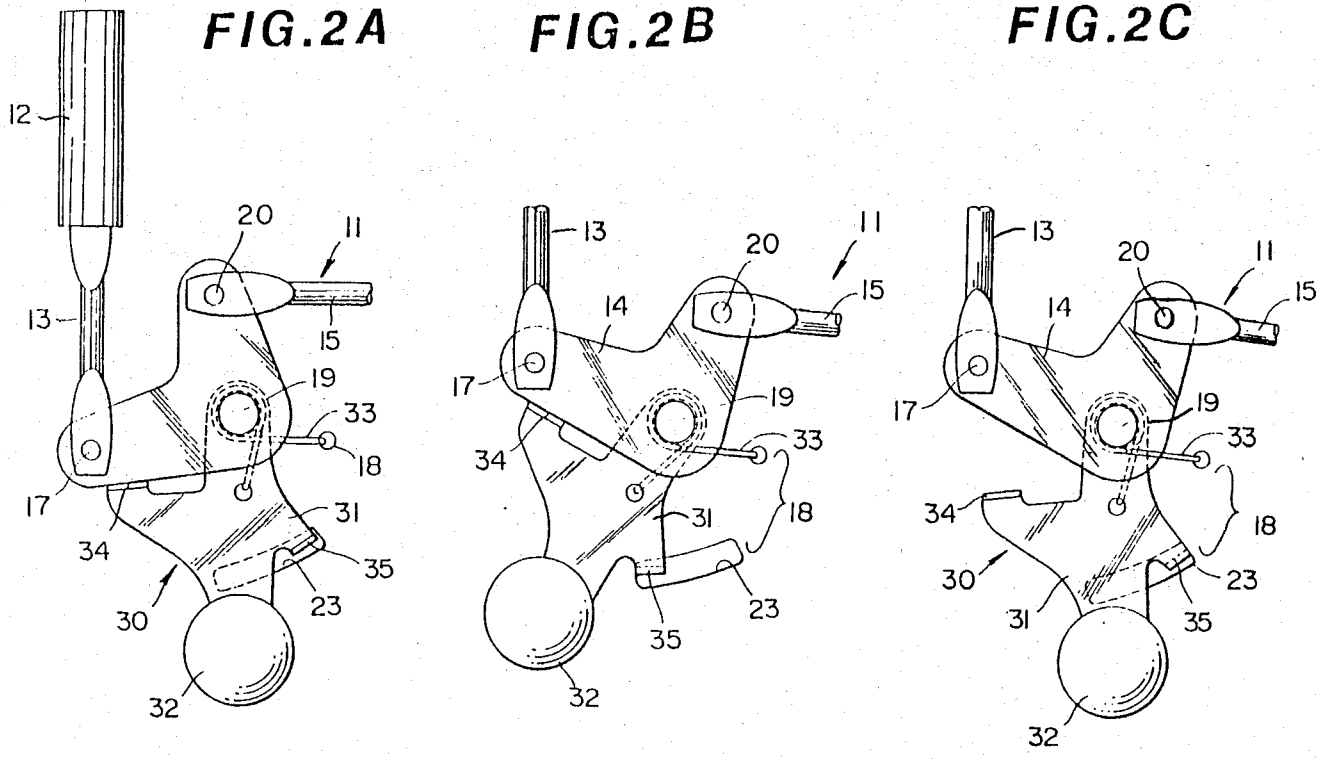
FIGS. 2A, 2B and 2C are side views of a portion of the locking system of the present invention in various positions.

The operation of the device of this embodiment mentioned above is as follows:

If deceleration exceeding a set value of the spring constant of the spring 33 is caused by a collision of the vehicle, the inertia lever 31 swings toward the clockwise direction in FIG. 2B by reason of its inertia. By this swing movement, the inertia lever 31 pushes up the lock knob side arm of the bell crank 14, as shown in FIG. 2B, and turns the lock lever 16 through the intermediate rod 15 to unlock the lock unit 1. Thus, the door can be opened from the outside of the vehicle by manipulating the outside handle. The door can be also opened by the inside handle, of course. After the movement due to inertia, the inertia lever 31 returns to its original normal position, as shown in FIG. 3C, by force of the spring 33.

Manipulation of the lock knob 12 is not disturbed at all by the inertia lever 31 because the inertia lever 31 is normally in its stationary normal position as mentioned above.

Figure 3:
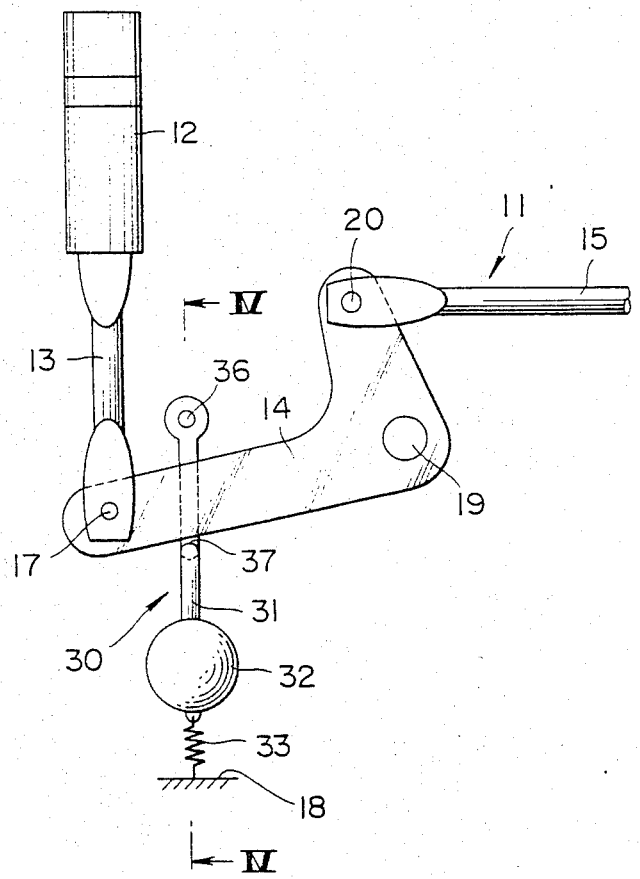
FIG. 3 is a side view of the locking system showing a second embodiment of the present invention.
Figure 4:
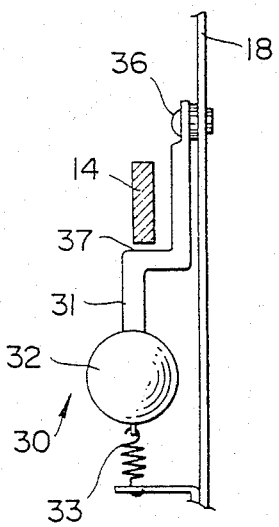
FIG. 4 is a sectional view taken along a line IV—IV of FIG. 3.

In the embodiment shown in FIGS. 3 and 4, the inertia actuator can be activated by a rear end collision as well.

An inertia lever 31 of this embodiment is pivotally mounted on the inner panel 18 of the door, for example, by means of a pin 36 at a position between the fulcrum of the bell crank 14, that is, the position of the pin 19, and the joint point of the knob rod 13, that is, the position of the pin 17. The inertia lever 31 is formed, at its intermediate portion, with an actuating portion 37 which lies adjacent, touching or not touching, to the underside of the knob rod side arm of the bell crank 14. A spring 33 is mounted between the underside of a weight portion 32 and the inner panel 18 of the door.

In this embodiment, too, a predetermined deceleration causes the inertia lever 31 to swing toward the clockwise direction in FIG. 3 by reason of inertia, and this pushes up the knob rod side arm of the bell crank 14 thus to effect automatic unlocking of the lock unit 1. On the other hand, a predetermined acceleration causes the inertia lever 31 to swing toward the counterclockwise direction in FIG. 3 and to push up the knob rod side arm of the bell crank 14. Therefore, the lock unit 1 is also automatically and reliably unlocked in the case of acceleration.

In the embodiment shown in FIG. 5, an inertia actuator 30 is activated by deceleration and acceleration in a symmetrical manner.

Figure 5C:
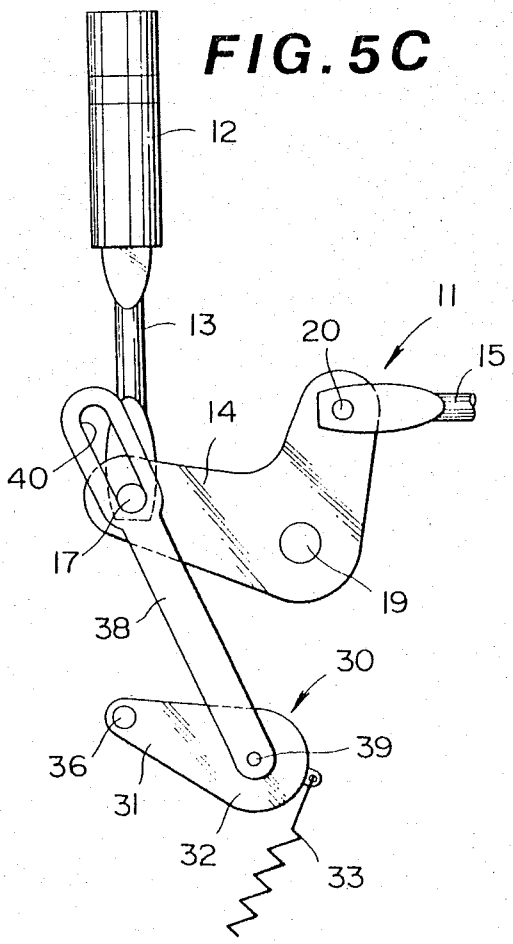
FIGS. 5A, 5B and 5C are side views showing a third embodiment of the present invention.
Figure 5B:
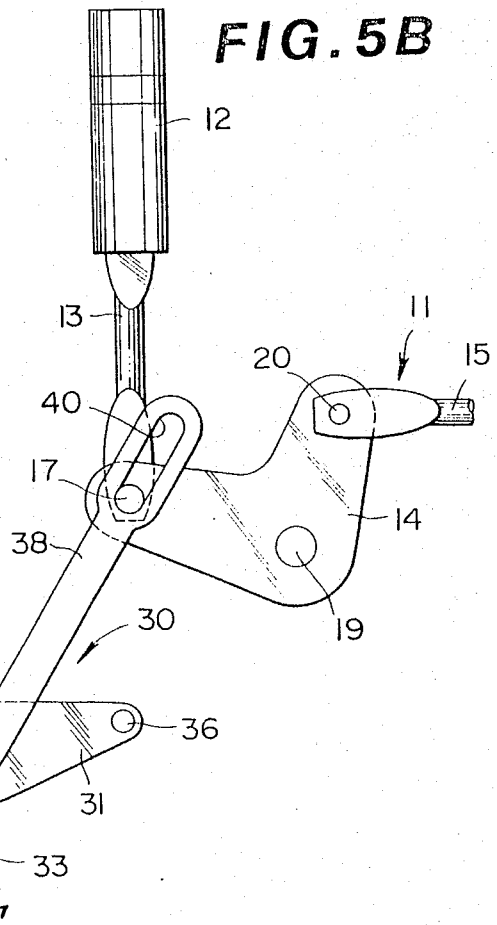
Figure 5A:
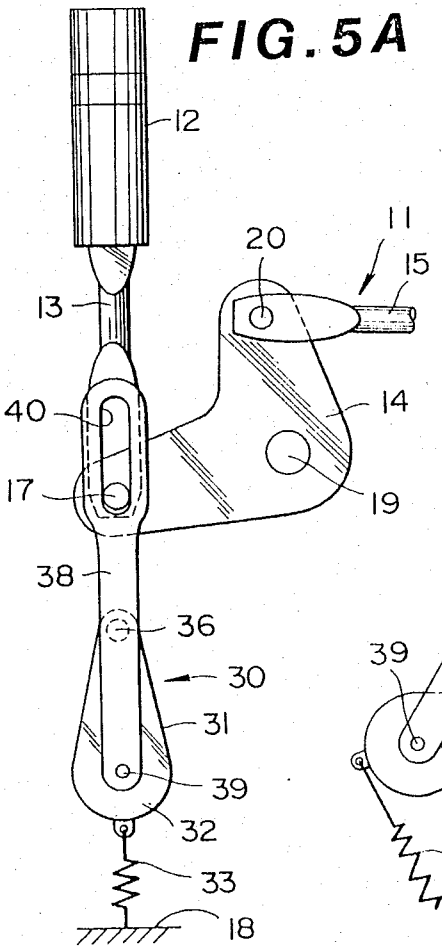

In this embodiment, an inertia lever 31 is pivotally mounted on the side of the door, that is, the inner panel of the door, for example, by means of a pin 36 at a position under the joint of the knob rod 13, that is, the position of the pin 17. A spring 33 is disposed between the underside of a weight portion 32 of the inertia lever 31 and the inner panel 18 of the door in the same manner as the embodiment of FIGS. 3 and 4. A transmission or actuating lever 38 is connected with the pin 17, and the lower end of the transmission lever 38 is connected with the weight portion 32 of the inertia lever 31 by a joint pin 39 forming a pin joint at a position on the center line of the inertia lever 31. Thus, the pins 17, 36, 39 and the connecting ends of the spring 33 are all aligned in a straight line, as shown in FIG. 5A. The transmission lever 38 is formed with a longitudinally extending slit 40 in which the pin 17 is received, so that the transmission lever 38 is not moved by the up and down movements of the knob rod 13 in normal use.

In this embodiment, the connecting point of the knob rod, the fulcrum of the inertia lever, the connecting points of the transmission lever and the connecting points of the spring are all placed on a straight line as mentioned above. Accordingly, in both the case of deceleration in which the inertia lever 31 swings toward the clockwise direction as shown in FIG. 5B and the case of acceleration in which the inertia lever 31 swings toward the counterclockwise direction as shown in FIG. 5C, deceleration and acceleration of the same rate cause the inertia lever 31 to swing to the same degree. Besides, inertial motion is transmitted through the transmission lever 38 to the bell crank 14 at the same point, that is, the connecting point of the knob rod 13 or the point of the pin 17. Thus, the operations caused by inertia are the same both in the cases of deceleration and acceleration, so that the reliability is improved.

Figure 6:
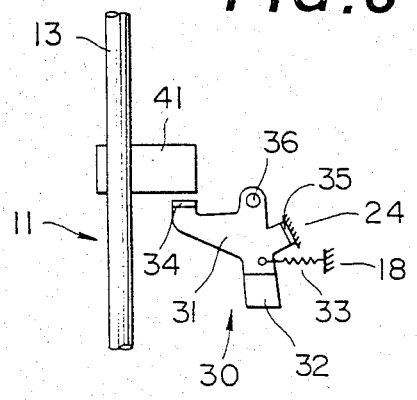
FIG. 6 is a side view showing a fourth embodiment of the present invention.

In the above mentioned embodiments, the inertia actuator 30 is related with the bell crank 14. If, however, the lock linkage 11 does not include a bell crank and the knob rod 13 connected with the lock knob 12 is directly connected with the lock lever 16, it is possible to relate the inertia actuator 30 with the knob rod 13, as shown in FIG. 6. In this case, the knob rod 13 is formed with an arm portion 41 at the intermediate portion. An inertia lever 31 of this embodiment is pivotally mounted on the side of the door, that is, the inner panel 18 of the door, for example, by means of a pin 36. An actuating portion 34 is formed in the inertia lever 31 at such a position that the actuating portion 34 lies near or in contact with the underside of the arm portion 41 of the knob rod 13 when the knob rod 13 is in its locking position. A setting spring 33 is disposed between a weight portion 32 of the inertia lever 31 and the inner panel 18. Thus, the setting spring 33 holds the inertia lever 31 in its stationary normal position in which a stopper portion 35 formed in the other side of the inertia lever 31 abuts on a stopper portion 24 formed in the inner panel 18 of the door.

When a predetermined deceleration takes place, the inertia lever 31 of this embodiment moves toward the clockwise direction in FIG. 6 by means of inertia and directly pushes up the knob rod 13 through its arm portion 41 thereby to automatically unlock the lock unit 1.

Figure 8:
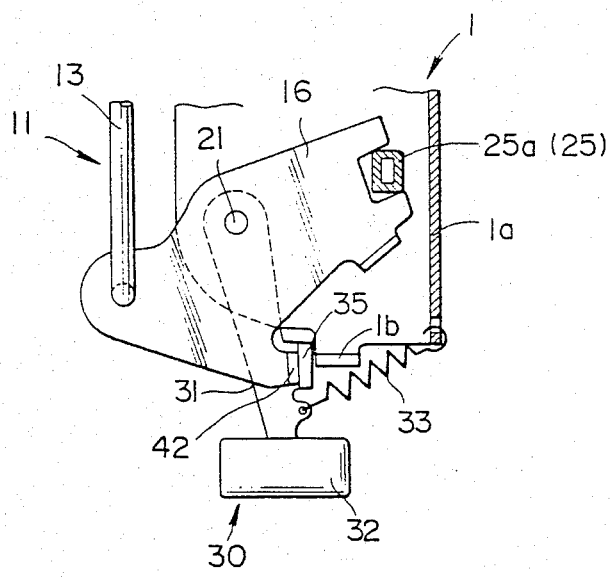
FIG. 8 is a side view partly in section of the system of FIG. 7.
Figure 7:
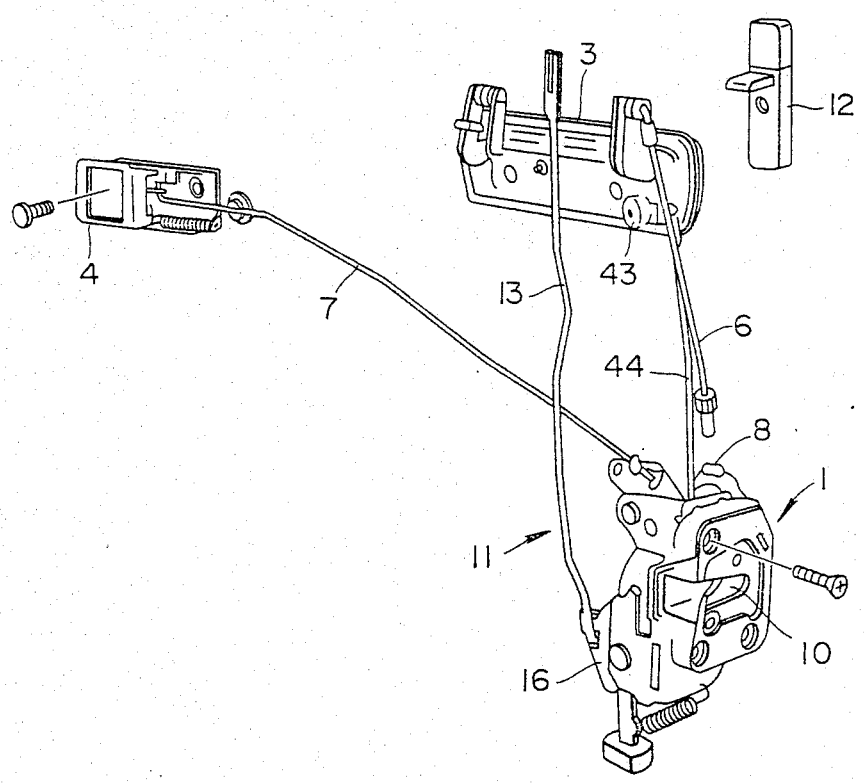
FIG. 7 is a perspective view showing a fifth embodiment of the present invention.

In the embodiment shown in FIGS. 7 and 8, the present invention is applied to the arrangement in which the lower end of a knob rod is directly connected with a lock lever 16. As shown in FIG. 8, the lock lever 16 is engaged with an arm portion 25*a* of an key lever 25 which is connected with a door lock cylinder 43 shown in FIG. 7 through a key rod 44. When the knob rod 13 is pushed down, the lock lever 16 pushes up the arm portion 25*a* of the key lever 25 into its locking position, and when the knob rod 13 is pulled up, it pushes down the key portion 25*a* into its unlocking position. An inertia lever 31 is coaxially supported on a fulcrum pin 21 of the lock lever 16. A setting spring 33 is extended between a portion of the inertia lever 31 adjacent to a weight portion 32 and the lower end of a casing 1*a* of the door lock unit 1. Thus, the setting spring 33 holds the inertia lever 31 stationary in such a position that a stopper portion 35 formed in one side of the inertia lever 31 abuts on a stopper portion 1*b* formed in the underside of the casing 1*a*. The lock lever 16 is formed, in the lower portion, with an arm portion 42 which projects toward the stopper portion 1*b*. The arm portion 42 lies close to or in contact with the stopper portion 35 of the inertia lever 31 when the lock lever 16 is in its locking position with the knob rod being pushed down.

When a predetermined deceleration takes place, the inertia lever 31 of this embodiment swings toward the clockwise direction in FIG. 8 by means of inertia and directly turns the lock lever 16 toward the unlocking direction to effect automatic unlocking.

What is claimed is:

1. A locking system for an automobile door comprising:

a locking unit for locking and unlocking the door, said lock unit having a locking position in which the door is locked and an unlocking position in which the door is not locked, input means, linkage means, connected between said input means and said lock unit, for transmitting movement from said input means to said lock unit and thereby making it possible to cause said lock unit to move from its locking position to its unlocking position or vice versa by moving said input means, said linkage means having a lock directing position in which said lock unit is in said locking position and an unlock directing position in which said locking unit is in said unlocking position, said linkage means comprising a movable member having a receiving portion, and inertia actuating means comprising pushing means having a weight portion swingable in a vertical plane about a fulcrum from a normal position into a first actuating position and an actuating portion which moves together with said weight portion, lies adjacent to said receiving portion of said linkage means when said linkage means is in said lock directing position and said weight portion is in said normal position, and pushes said receiving portion to move said lock unit from its locking position to its unlocking position by moving said linkage means from said lock directing position to said unlock directing position when said weight portion swings from said normal position to said first actuating position, said inertia actuating means further comprising holding means which comprises a spring for normally holding said weight portion in said normal position irrespective of whether said linkage means is in said lock directing position or in said unlock directing position, and allowing said weight portion to swing from said normal position to said first actuating position by reason of its inertia when vehicle deceleration at a rate higher than a predetermined level takes place, said linkage means being capable of moving between said lock and unlock directing positions without causing said inertia actuating means to move as long as said weight portion is held in said normal position, said pushing means comprising an inertia lever which has a lower end having said weight portion and an upper end having said fulcrum and is capable of swinging in said vertical plane on said fulcrum from said normal position to said first actuating position, said inertia lever being capable of swinging into a second actuating position opposite to said first actuating position by reason of its inertia when a vehicle acceleration of a rate higher than a predetermined level takes place, said inertia actuating means causing said linkage means to move from its lock directing position to its unlock directing position when said inertia lever swings from its normal position to its second actuating position.

2. A locking system according to claim 1, wherein said movable member of said linkage means is a linkage lever having a first arm and a second arm and is capable of swinging in a vertical plane on a fulcrum at the apex of the angle formed by said first arm and said second arm, said inertia lever pushing said first arm to move said linkage means from its lock directing position to its unlock directing position when said inertia lever swings from its normal position to its first actuating position.

3. A locking system according to claim 2, wherein said inertia lever is capable of swinging from its normal position to a second actuating position opposite to said first actuating position by reason of its inertia when an acceleration of a rate higher than a predetermined level takes place, said inertia lever pushing said first arm of said linkage lever to move said linkage means from its lock directing position to its unlock directing position when said inertia lever swings from its normal position to its second actuating position.

4. A locking system according to claim 1, wherein said actuating means further comprises an actuating lever, a lower end of which is connected with a swingable portion of said inertia lever by means of a first joint pin forming a pin joint, and an upper end of which is connected with said first arm of said linkage lever by means of a second joint pin forming a pin joint, said first joint pin, said secnd joint pin and said fulcrum of said inertia lever being all horizontal and lying on the same vertical plane when said inertia lever is in its normal position, said actuating lever being formed, in its upper end, with a longitudinally extending slot which slidably receives said second joint pin, said second joint pin lying adjacent to the lower end of said slot when said enertia lever is in its normal positon and said linkage means is in its lock directing position, said inertia lever being capable of swinging not only to said first actuating position in response to deceleration but also to a second actuating position when an acceleration of a rate higher than a predetermined level takes place.

5. A locking system according to claim 1, wherein said inertia lever is vertically suspended from said fulcrum in said normal position, and said spring extends vertically from an upper end to a lower end when said inertia lever is in said normal position, said upper end of said spring being connected with said lower end of said inertia lever.

* * * * *